US007029625B2

(12) United States Patent
Shimosato et al.

(10) Patent No.: US 7,029,625 B2
(45) Date of Patent: Apr. 18, 2006

(54) CONTINUOUS VACUUM CARBURIZING FURNACE

(75) Inventors: Yoshikazu Shimosato, Osaka (JP); Seiji Yoshimoto, Osaka (JP)

(73) Assignee: Chugai Ro Co., Ltd., Osaka (JP)

( * ) Notice: Subject to any disclaimer, the term of this patent is extended or adjusted under 35 U.S.C. 154(b) by 39 days.

(21) Appl. No.: 10/708,737

(22) Filed: Mar. 22, 2004

(65) Prior Publication Data

US 2004/0239019 A1 Dec. 2, 2004

(30) Foreign Application Priority Data

May 26, 2003 (JP) ..... 2003-147990

(51) Int. Cl.
*C21D 1/773* (2006.01)

(52) U.S. Cl. ..... 266/252; 266/250

(58) Field of Classification Search ..... 266/252, 266/250

See application file for complete search history.

(56) References Cited

U.S. PATENT DOCUMENTS 4,807,853 A * 2/1989 Murakami et al. ..... 266/250
6,767,504 B1 * 7/2004 Hattori et al. ..... 266/252

FOREIGN PATENT DOCUMENTS

EP 0 147 845 7/1985
JP 2002-146512 5/2002
JP 2003-113414 4/2003

OTHER PUBLICATIONS

Altena H.: "Niederdruck-Aufkohlung mit Hochdruck-Gasabschreckung Verfahrenstechnik und Ergebnisse" Haerterei Technische Mitteilungen, Carl Hans Verlag, vol. 53, No. 2, Mar. 1, 1998, pp. 93-101, XP-000755093 Munchen, DE *p. 94-p.99*.
European Search Report dated Sep. 10, 2004.

* cited by examiner

*Primary Examiner*—Scott Kastler
(74) *Attorney, Agent, or Firm*—Armstrong, Kratz, Quintos, Hanson & Brooks, LLP.

(57) ABSTRACT

A continuous vacuum carburizing furnace of the invention includes: a heating chamber for heating a workpiece under a atmospheric pressure; a first conditioning chamber in which the pressure is reduced from the atmospheric pressure after the receipt of the workpiece from the heating chamber; a carburizing/diffusing chamber receiving plural workpieces from the first conditioning chamber and conducting plural cycles of carburizing and diffusing processes under the reduced pressure; a second conditioning chamber in which the reduced pressure is returned to the atmospheric pressure after the receipt of the workpiece treated in the carburizing/diffusing chamber; and a cooling chamber for cooling the workpiece introduced from the second conditioning chamber under the atmospheric pressure, the furnace further comprising a door member disposed between a respective adjoining pair of the above chambers, the door member opened/closed only when the workpiece is transported from one chamber to another.

4 Claims, 2 Drawing Sheets

CONTINUOUS VACUUM CARBURIZING FURNACE

BACKGROUND OF THE INVENTION

1. Field of the Invention

The present invention relates to a continuous vacuum carburizing furnace used for carburizing workpieces such as steel parts. More particularly, the invention relates to a continuous vacuum carburizing furnace for continuously performing a sequence of steps including: heating a workpiece; subjecting the heated workpiece to carburizing and diffusing processes under a reduced pressure; and cooling the workpiece, the furnace characterized by suppressing the production of cementite and by providing efficient and easy control of the carburized case depth or surface carbon content of the workpiece.

2. Description of the Related Art

For the purpose of increasing the strength of steel parts, such as of low-carbon steel or low-alloy steel, it has been a conventional practice to subject the steel parts to the carburizing process for diffusing and penetrating carbon thereinto.

A variety of methods are used for carburizing workpieces including the steel parts or the like. As one example of these methods, there is known one employing a continuous vacuum carburizing furnace.

According to the prior art, the workpieces such as the steel parts are carburized using the continuous vacuum carburizing furnace as follows. As generally shown in FIG. 1, each workpiece 1 accommodated in a basket or the like is introduced in turn from a load chamber 8 into a heating chamber 2 via a door member 3 disposed at an inlet of the heating chamber 2. In the heating chamber 2, the workpieces 1 are sequentially heated. Then, one of the workpieces 1 thus heated is introduced into a carburizing chamber 4 under a reduced pressure via a door member 3*a*. A carburizing gas comprising gaseous hydrocarbon is fed into the carburizing chamber 4 so as to supply carbon to the workpiece 1 for carrying out carburization under the reduced pressure. Subsequently, the workpiece 1 is introduced into a diffusing chamber 5 under a reduced pressure via a door member 3*b*. In the diffusing chamber 5, the carbon supplied to the workpiece 1 is allowed to diffuse thereinto under the reduced pressure. Thereafter, the workpiece 1 is introduced from the diffusing chamber 5 into a cooling chamber 6 via a door member 3*c*. In the cooling chamber 6, the temperature of the above workpiece 1 is lowered. Subsequently, the workpiece 1 is introduced from the cooling chamber 6 into a quenching chamber 7 via a door member 3*d* and subjected to quenching. The quenched workpiece 1 is discharged via a door member 3*e* disposed at an exit of the quenching chamber 6.

In a case where the workpieces 1 are carburized in this manner, it is necessary to vary the length of heat time taken by the heating chamber 2, the length of carburizing time taken by the carburizing chamber 4 or the length of diffusion time taken by the diffusing chamber 5 in order to control the carburized case depth or the surface carbon content of the workpiece 1 and also to suppress the production of cementite. In some cases, the heat time taken by the heating chamber 2, the carburizing time taken by the carburizing chamber 4 and the diffusion time taken by the diffusing chamber 5 may be varied greatly.

However, where the heat time taken by the heating chamber 2, the carburizing time taken by the carburizing chamber 4 and the diffusion time taken by the diffusing chamber 5 are varied greatly in the aforesaid continuous vacuum carburizing furnace, there is a difficulty of continuously introducing the workpieces 1 into the heating chamber 2, the carburizing chamber 4 and the diffusing chamber 5 in sequence. This leads to inability to accomplish an efficient carburization of the workpieces 1.

More recently, there has been proposed an alternative continuous vacuum carburizing furnace including load chamber, heating chamber, carburizing chamber, diffusing chamber, cooling/holding chamber and quenching chamber, as disclosed in Japanese Unexamined Patent Publication No. 2002-146512. The furnace features a plurality of carburizing chambers, each of which is designed as a carburizing/diffusing chamber functioning as both the carburizing chamber and the diffusing chamber, and at least one of which is provided with a heating function such as to function as the heating chamber.

In such a continuous vacuum carburizing furnace, the heating chamber and the individual carburizing/diffusing chambers are reduced in pressure so as to carry out the heating process, carburizing process or diffusing process under the reduced pressure. In the meantime, individual workpieces accommodated in respective baskets are sequentially introduced into the respective carburizing/diffusing chambers so as to be subjected to the carburizing and diffusing processes.

However, the heating chamber and the carburizing/diffusing chambers discretely maintained in the reduced pressure entail cost increase. On the other hand, it is an extremely cumbersome and inefficient operation to open/close a door member to the carburizing/diffusing chamber each time each workpiece in the basket is introduced into each of the carburizing/diffusing chambers in turn and then to subject the workpiece to the carburizing and diffusing processes in the respective carburizing/diffusing chambers. In addition, the furnace is increased in size.

SUMMARY OF THE INVENTION

The invention has an object to provide a continuous vacuum carburizing furnace used for carburizing the workpieces, the furnace capable of suppressing the production of cementite and adapted for efficient and easy control of the carburized case depth or the surface carbon content of the workpiece.

According to the invention, a continuous vacuum carburizing furnace comprises: a heating chamber for heating a workpiece under a atmospheric pressure; a first conditioning chamber in which the pressure is reduced from the atmospheric pressure after the receipt of the workpiece from the heating chamber; a carburizing/diffusing chamber receiving plural workpieces from the first conditioning chamber and conducting plural cycles of carburizing and diffusing processes under the reduced pressure; a second conditioning chamber in which the reduced pressure is returned to the atmospheric pressure after the receipt of the workpiece treated in the carburizing/diffusing chamber; and a cooling chamber for cooling the workpiece introduced from the second conditioning chamber under the atmospheric pressure, the furnace further comprising a door member disposed between a respective adjoining pair of the above chambers, the door member opened/closed only when the workpiece is transported from one chambers to another.

In the continuous vacuum carburizing furnace of the invention, the workpiece is heated in the heating chamber under the atmospheric pressure, as described above. This negates the need for reducing the pressure in the heating chamber and hence, the initial and running costs are decreased.

According to the continuous vacuum carburizing furnace of the invention, a plural number of workpieces from the first conditioning chamber are received by a single carburizing/diffusing chamber, wherein the carburizing and diffusing processes are repeated in plural cycles. Hence, the number of times to open/close the door member is decreased so as to increase the efficiency, as compared with the case where the door members at the plural carburizing/diffusing chambers are opened/closed to sequentially introduce the individual workpieces into the respective carburizing/diffusing chambers for discretely carrying out the carburizing and diffusing processes. Furthermore, the furnace of the invention provides an easy control of the carburizing and diffusing processes.

The continuous vacuum carburizing furnace of the invention may also be arranged such that the carburizing and diffusing processes are carried out in the first conditioning chamber between the heating chamber and the carburizing/diffusing chamber or in the second conditioning chamber between the carburizing/diffusing chamber and the cooling chamber. Such an arrangement provides an efficient control of the carburized case depth or surface carbon content of the workpiece in a broader range.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

A continuous vacuum carburizing furnace according to one embodiment of the invention will be specifically described with reference to the accompanying drawings. It is noted that the continuous vacuum carburizing furnace according to the invention is not limited to the following embodiments but may be practiced in modification as required so long such a modification does not depart from the scope of the invention.

Figure 1:
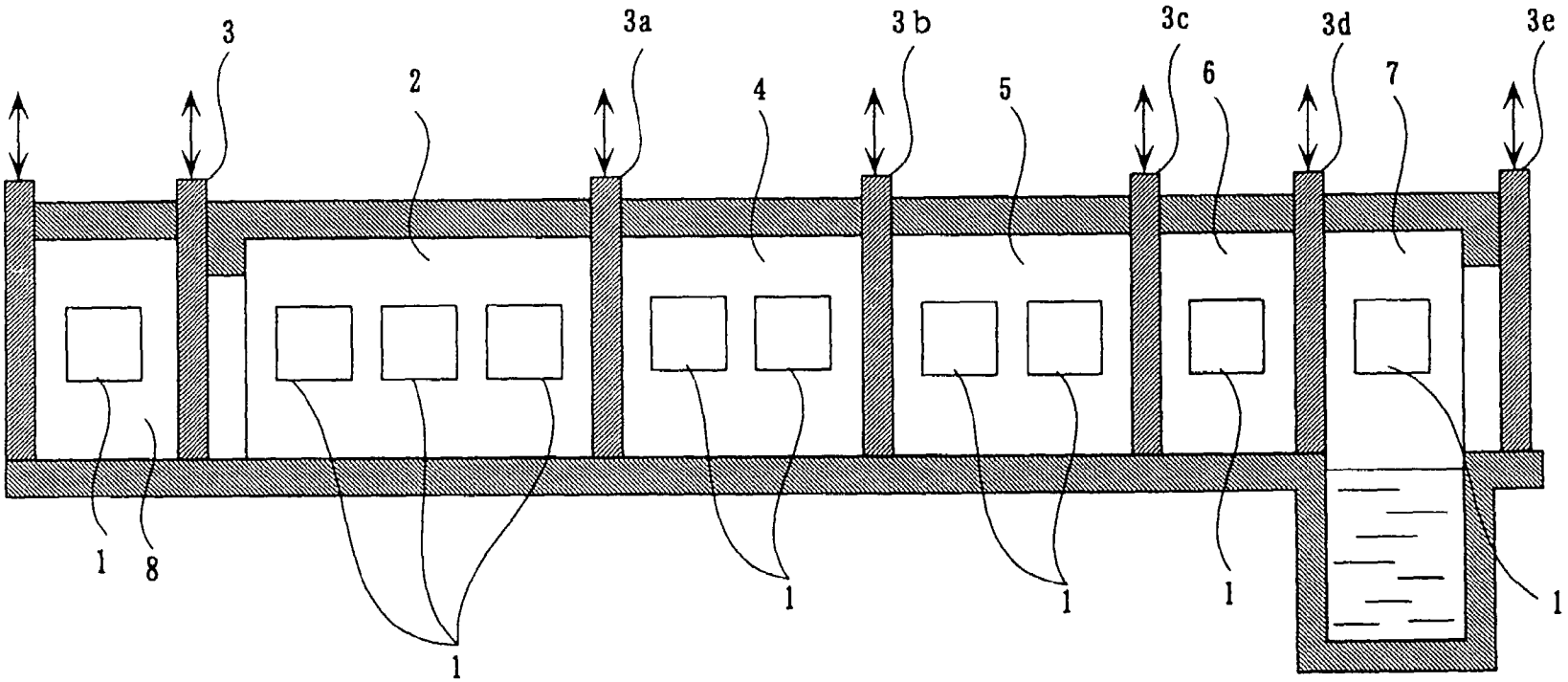
Fig 1 PRIOR ART
FIG. 1 is a diagram schematically illustrating how workpieces are carburized by a conventional continuous vacuum carburizing furnace.
Figure 2:
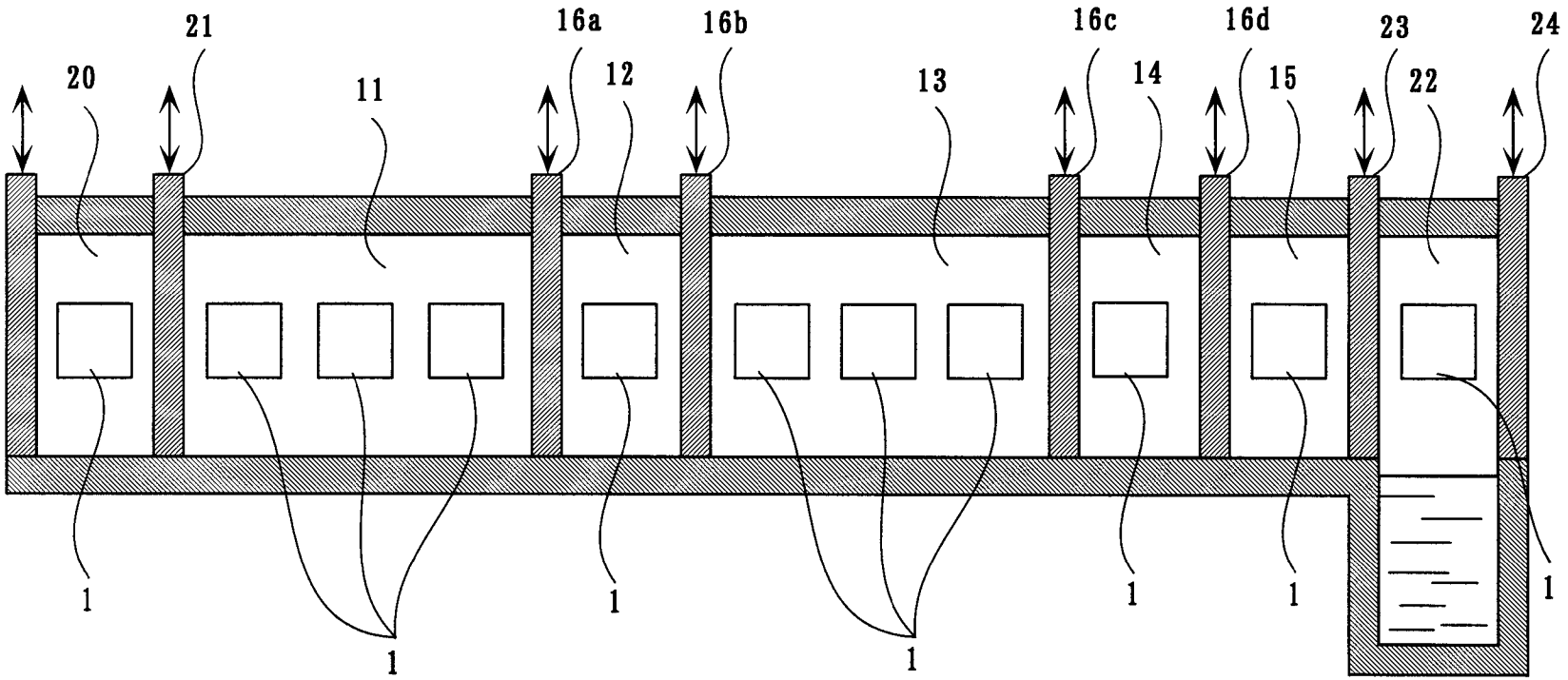
FIG. 2 is a diagram schematically illustrating how workpieces are carburized by a continuous vacuum carburizing furnace according to one embodiment of the invention.

As shown in FIG. 2, the continuous vacuum carburizing furnace according to the embodiment includes: a heating chamber 11 for heating a workpiece 1 under a atmospheric pressure; a first conditioning chamber 12 into which the workpiece 1 heated in the heating chamber 11 is introduced; a carburizing/diffusing chamber 13 receiving plural workpieces 1 from the first conditioning chamber 12 and conducting plural cycles of carburizing and diffusing processes under a reduced pressure; a second conditioning chamber 14 into which the workpiece 1 treated in the carburizing/diffusing chamber 13 is introduced; and a cooling chamber 15 for cooling the workpiece 1 introduced from the second conditioning chamber 14, the chambers arranged in a continuous manner. The furnace further includes door members 16*a*, 16*b*, 16*c*, 16*d* disposed between the above chambers 11, 12, 13, 14, 15 for allowing the transportation of the workpiece 1 between the chambers.

According to the continuous vacuum carburizing furnace of the embodiment, the pressure in the first conditioning chamber 12 is reduced after the workpiece 1 heated in the heating chamber 11 is introduced therein. On the other hand, the reduced pressure in the second conditioning chamber 14 is returned to the atmospheric pressure after the workpiece 1 treated in the carburizing/diffusing chamber 13 is introduced therein.

The continuous vacuum carburizing furnace of the embodiment carburizes the workpiece 1 as follows. Each workpiece 1 accommodated in a basket is introduced in turn from a load chamber 20 into the heating chamber 11 via a door member 21 disposed at an inlet of the heating chamber 11. In the heating chamber 11, a plurality of workpieces 1 (3 workpieces 1 are illustrated in the figure) are sequentially heated to a predetermined temperature, or to about 950° C. in general.

Then, the door member 16*a* disposed between the heating chamber 11 and the first conditioning chamber 12 is opened to introduce one of the workpieces 1 thus heated in the heating chamber 11 into the first conditioning chamber 12. While the workpiece 1 is maintained at the predetermined temperature, the pressure in the first conditioning chamber 12 is reduced from the atmospheric pressure to about 0.01 to 0.1 Kpa. In a case where the carburized case depth of the workpiece 1 is increased, a carburizing gas such as acetylenic gas is fed into the first conditioning chamber 12 under the aforesaid reduced pressure thereby to increase the internal pressure thereof to about 1.1 to 3.5 Kpa. In this state, the workpiece is subjected to the carburizing process for a predetermined period of time. Subsequently, the pressure in the first conditioning chamber 12 is reduced to about 0.01 to 0.1 Kpa so as to allow the resultant carbon to diffuse into the workpiece 1. As required, the above operations may be repeated.

Next, with the first conditioning chamber 12 maintained under the reduced pressure, the door member 16*b* between the first conditioning chamber 12 and the carburizing/diffusing chamber 13 is opened to introduce the above workpiece 1 into the carburizing/diffusing chamber 13 under the reduced pressure of about 0.01 to 0.1 Kpa.

While the workpiece 1 in the carburizing/diffusing chamber 13 is maintained at the predetermined temperature, the aforesaid carburizing gas is fed into the carburizing/diffusing chamber 13 under the reduced pressure thereby to increase the internal pressure thereof to about 1.1 to 3.5 Kpa. In this state, the workpiece is subjected to the carburizing process for a predetermined period of time. Subsequently, the pressure in the carburizing/diffusing chamber 13 is reduced to about 0.01 to 0.1 Kpa for allowing the resultant carbon to diffuse into the workpiece 1.

With the carburizing/diffusing chamber 13 maintained under the reduced pressure, the door member 16*b* between the first conditioning chamber 12 and the carburizing/diffusing chamber 13 is opened to introduce the succeeding workpiece 1 from the first conditioning chamber into the carburizing/diffusing chamber 13. In the continuous vacuum carburizing furnace of the embodiment, the aforementioned operations are repeated in cycles thereby to accommodate 3 workpieces 1 in the carburizing/diffusing chamber 13 so that the individual workpieces 1 may be subjected to respectively predetermined numbers of carburizing and diffusing processes.

While the workpieces 1 individually subjected to the respectively predetermined numbers of carburizing and diffusing processes are maintained at the predetermined temperature in the carburizing/diffusing chamber 13, the door member 16*c* between the carburizing/diffusing chamber 13 and the second conditioning chamber 14 is opened to introduce the above workpiece 1 into the second conditioning chamber 14 reduced in pressure to about 0.01 to 0.1 Kpa. Subsequently, the reduced pressure in the second conditioning chamber 14 is increased to the atmospheric pressure. In a case where the carburized case depth of the above workpiece 1 is further increased, the aforesaid carburizing gas is fed into the second conditioning chamber 12 under the reduced pressure and the workpiece is subjected to the carburizing process for a predetermined period of time. Thereafter, the pressure in the second conditioning chamber 12 is reduced to allow the resultant carbon to diffuse into the workpiece 1. Subsequently, the reduced pressure in the second conditioning chamber 14 is increased to the atmospheric pressure.

After the reduced pressure in the second conditioning chamber 14 is returned to the atmospheric pressure, the door member 16*c* between the second conditioning chamber 14 and the cooling chamber 15 is opened to introduce the above workpiece 1 into the cooling chamber 15 under the atmospheric pressure. In the cooling chamber 15, the workpiece 1 at the predetermined temperature of about 950° C. is cooled to about 850° C.

After the workpiece 1 is cooled to about 850° C. in the cooling chamber 15, a door member 23 disposed between the cooling chamber 15 and the quenching chamber 22 is opened to introduce the above workpiece 1 into the quenching chamber 22. Then, the workpiece 1 is quenched in the quenching chamber 22. The quenched workpiece 1 is discharged via a door member 24 disposed at an exit of the quenching chamber 22.

The continuous vacuum carburizing furnace of the embodiment may vary the number of times to repeat the carburizing and diffusing processes or the diffusion time in the carburizing/diffusing chamber 13, thereby accomplishing both the suppressed cementite production and the controlled carburized case depth or surface carbon content of the workpiece 1. In addition, the carburizing process or the diffusing process may be selectively carried out in the first conditioning chamber 12 or the second conditioning chamber 14 whereby the carburized case depth or surface carbon content of the workpiece 1 is controlled in an even broader range.

Although the present invention has been fully described by way of examples, it is to be noted that various changes and modifications will be apparent to those skilled in the art.

Therefore, unless otherwise such changes and modifications depart from the scope of the invention, they should be construed as being included therein.

The invention claimed is:

1. A continuous vacuum carburizing furnace comprising: a heating chamber for heating a workpiece under a atmospheric pressure; a first conditioning chamber in which the pressure is reduced from the atmospheric pressure after the receipt of the workpiece from the heating chamber; a carburizing/diffusing chamber receiving plural workpieces from the first conditioning chamber and conducting plural cycles of carburizing and diffusing processes under the reduced pressure; a second conditioning chamber in which the reduced pressure is returned to the atmospheric pressure after the receipt of the workpiece treated in the carburizing/diffusing chamber; and a cooling chamber for cooling the workpiece introduced from the second conditioning chamber under the atmospheric pressure, the furnace further comprising a door member disposed between a respective adjoining pair of the above chambers, the door member opened/closed only when the workpiece is transported from one chamber to another.

2. The continuous vacuum carburizing furnace as claimed in claim 1, wherein said door member is disposed between said heating chamber and said first conditioning chamber, wherein said workpiece is subjected to carburization and diffusion in said first conditioning chamber under the reduced pressure.

3. The continuous vacuum carburizing furnace as claimed in claim 1, wherein said door member is disposed between said first conditioning chamber and said carburizing/diffusing chamber, wherein said workpiece is subjected to carburization and diffusion in said second conditioning chamber under the reduced pressure.

4. The continuous vacuum carburizing furnace as claimed in claim 1, wherein said door member is disposed between said carburizing/diffusing chamber and said second conditioning chamber, wherein said workpiece is of a steel material.

* * * * *